United States Patent [19]

Cottle

[11] 4,070,160

[45] Jan. 24, 1978

[54] GASIFICATION PROCESS WITH ZINC CONDENSATION ON THE CARBON SOURCE

[75] Inventor: John E. Cottle, Bartlesville, Okla.

[73] Assignee: Phillips Petroleum Company, Bartlesville, Okla.

[21] Appl. No.: 794,421

[22] Filed: May 9, 1977

[51] Int. Cl.[2] ..... C10J 3/06

[52] U.S. Cl. ..... 48/197 R; 48/202; 48/210; 252/373; 423/415 A

[58] Field of Search ..... 48/197 R, 210, 202; 423/415 A, 107; 75/86, 88; 252/373

[56] References Cited

U.S. PATENT DOCUMENTS

| | | | |
|---|---|---|---|
| 799,743 | 9/1905 | Mackay | 75/88 |
| 1,484,225 | 2/1924 | Lundin | 48/210 |
| 1,899,184 | 2/1933 | Simo | 75/86 |
| 2,342,368 | 2/1944 | Queneau | 75/86 |
| 2,602,809 | 7/1952 | Dickinson | 260/449 |
| 2,682,457 | 6/1954 | Gorin | 48/197 R |
| 2,691,573 | 10/1954 | Mayland | 48/210 |
| 2,844,453 | 7/1958 | Kapp et al. | 48/196 |

*Primary Examiner*—S. Leon Bashore
*Assistant Examiner*—Peter F. Kratz

[57] ABSTRACT

In a process for gasifying solid carbon sources such as coal utilizing zinc oxide as the oxygen donor, the carbon source is first contacted in a preheat zone with product gas; any zinc in this product gas is condensed on the carbon source; the preheated carbon source and zinc are then exposed to steam whereby the zinc is oxidized to zinc oxide; the mixture of zinc oxide and carbon source finally is reacted at elevated temperature conditions to form a gas comprising carbon monoxide and zinc.

11 Claims, 3 Drawing Figures

GASIFICATION PROCESS WITH ZINC CONDENSATION ON THE CARBON SOURCE

The present invention relates to the production of carbon monoxide. More specifically, the present invention relates to the gasification of such carbon sources as coal.

BACKGROUND OF THE INVENTION

Various carbon sources have been reported to be convertible to gases such as hydrocarbons by first converting these carbon sources to a carbon monoxide comprising gas. One process that has been processed for this purpose involves the reaction of the carbon source with zinc oxide, the separation of zinc from the carbon dioxide and a zinc-comprising gas produced, the reoxidation of the zinc to zinc oxide and the reintroduction thereof into the reaction with the carbon source. There is a general need for further improvements of this basic process, particularly since economical reasons constitute a dominating factor for success or failure of any gasification process. The recovery of zinc and the most complete use of the heat developed in the process thus are of utmost importance.

THE INVENTION

It is thus one object of this invention to provide a new process for the gasification of such materials as coal.

Another object of this invention is to provide a gasification process utilizing zinc oxide as the oxygen donor wherein the zinc is completely recovered.

A further object of this invention is an energy efficient gasification process.

These and other objects, advantages, details, features and embodiments of this invention will become apparent to those skilled in the art from the following description of the invention, the appended claims and the drawings in which:

Figure 1:
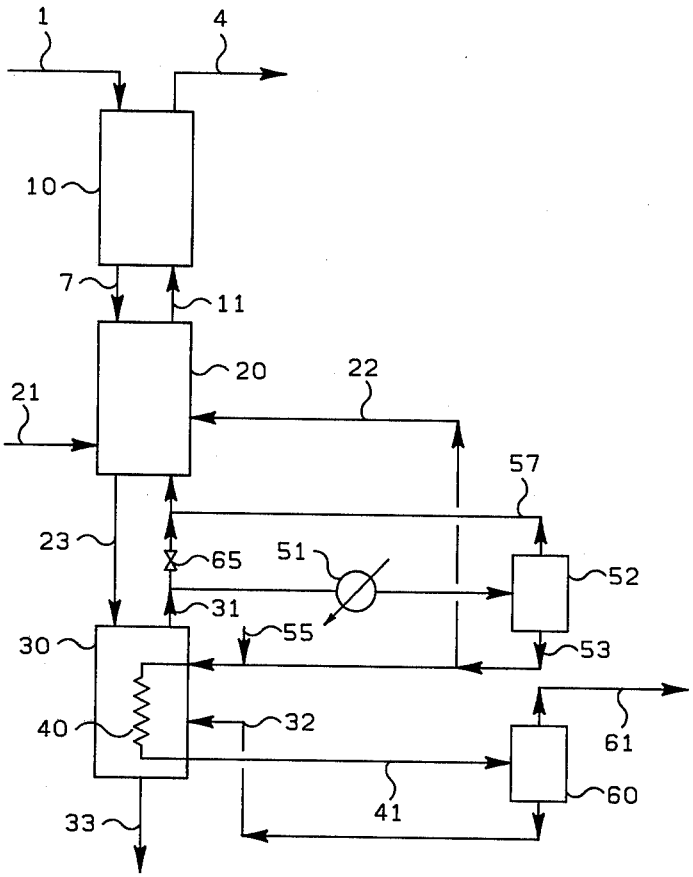
FIG. 1 is a principal flow sheet illustrating the process of this invention.

The present invention resides in a process for gasifying carbon sources utilizing zinc oxide as the oxygen donor in which process the carbon source is contacted in a preheating step with at least a portion of the gas produced in the gasification zone. The carbon source is thereby preheated and any zinc present in this portion of the gas is condensed on the carbon source. The carbon source together with zinc is exposed to steam for oxidizing the zinc to zinc oxide thus forming a mixture of the carbon source with zinc oxide. In the final gasification step the carbon source and zinc oxide are reacted to form a gas comprising carbon monoxide and zinc.

The process of this invention provides several important advantages. The carbon source is preheated by the direct countercurrent contacting with at least a portion of the product gases so that a considerable portion of the sensible heat of these gases above the temperature of the carbon source feedstock is recovered. All the volatiles such as water, light hydrocarbons and even some coal tar products are volatilized and stripped from the carbon source in this preheating step of the invention. This is of particular advantage in cases where the carbon source contains a significant amount of these materials as in the case of coal.

Furthermore, any uncondensed zinc in the gases utilized to contact the carbon source is recovered by condensation of this zinc onto the carbon source particles. This advantage is very significant because molten zinc has an appreciable vapor pressure at temperatures far below its boiling point of 907° C. For example, at 730° C. the vapor pressure of zinc is still about 100 mm Hg.

In one embodiment of this invention, the carbon monoxide and zinc comprising gas leaving the gasification zone is split into two streams and one of these streams is directly contacted with the carbon source in the preheating zone. In this embodiment the gas stream contacting the carbon source is a zinc-rich stream. The remaining stream is introduced into a zinc separation zone in which the zinc is removed from this gas stream. The zinc-lean gas stream preferably is also contacted with the carbon source.

In another embodiment of this invention, the carbon monoxide and zinc-comprising gas stream from the gasification zone is passed to a zinc separation zone where the major portion of the zinc is separated from this gas stream, e.g., by condensation. The remaining zinc-lean gas stream is passed into contact with the carbon source resulting in a zinc-free carbon monoxide comprising product gas stream. Zinc is condensed on the carbon source.

The zinc from the zinc separation zone can be introduced as such into the oxidation zone where the zinc in contact with the carbon zone and in the presence of steam is reacted into zinc oxide and hydrogen. A portion of the zinc can also be converted to zinc oxide in a zinc combustion zone by contacting the zinc with a free oxygen-containing gas such as air. Preferably, the thermal energy of this zinc combustion zone is utilized in order to supply at least a portion of the heat consumed in the endothermic gasification reaction between the carbon source and the zinc oxide in the gasification zone.

The relative quantities of the zinc utilized in the zinc oxidation zone, where zinc and steam are reacted, and in the zinc combustion zone (if present), where zinc and free oxygen are reacted to form zinc oxide depend entirely on the heat balance situation of the plant design. It is possible to operate the entire process without external heat sources so that the heat consumed in the gasification reaction between the carbon source and the zinc oxide is entirely supplied by the preheating both in the preheating zone and the zinc oxidation zone as well as by the heat generated in the zinc combustion zone. Depending upon the efficiency of the heat transfer between the zinc combustion zone and the gasification zone, typically the ratio of zinc oxidized in the zinc oxidizing zone with steam and zinc combusted in the zinc combustion zone with free oxygen-containing gas such as air will be from about 0.2 to about 10.

The preheating zone in the process of the present invention serves to recover all zinc from the product gas stream and a considerable portion of the sensible heat of the gases. The oxidation zone serves to generate zinc oxide in contact with the carbon source utilizing steam as the oxygen source. It is desirable to have as much of the zinc condensed on the feed solids as possible. In practice this quantity will be limited by the heat balance and the desired operating temperature in the zinc oxidation zone. The maximum amount of zinc introduced into this zinc oxidation zone is limited to the stoichiometric quantity which can be oxidized by the steam. Zinc oxide deposited on the feed solids via condensation will be present in a very finely divided state and very uniformly distributed over the surface of the solids. The subsequent conversion of zinc oxide and carbon into carbon monoxide and zinc will, therefore, be very efficient.

The process of this invention minimizes the use of indirect heat exchangers and also reduces the size of zinc separation zones. Thus, the investment costs for such a plant are reduced while at the same time the thermal efficiency of the process is increased. Some or all of the steam required may be generated by heat exchange with gasifier effluent. Depending upon the operating conditions a fraction of the carbon source may be already gasified in the zinc oxidation zone. This is, however, not detrimental to the process because the gas produced in this section of the process is essentially of the same composition as the gas desired.

For further specific process details and in order to avoid repetition specific reference is herewith made to the claims as originally filed.

The term "solid carbon source" as used herein is intended to refer to carbonaceous materials excluding gaseous or liquid hydrocarbons. The group of carbonaceous materials to which the process of this invention is particularly applicable and which, therefore, constitutes the preferred group of carbon sources includes carbon sources that are solid under normal temperature and pressure conditions. Preferred carbon sources are solid particles consisting essentially of materials selected from the group of coal, char and coke. The process of the invention is particularly applicable to the gasification of char which is the solid residue of several coal gasification or pyrolysis processes such as the COED process (developed by the FMC Corporation), the Garrett process, the Synthane process and the Toscoal process.

The solid carbon source materials are used in the process of this invention, preferably in finely divided form, in order to achieve as good and as much contact with the product gas as well as the zinc oxide as possible. Preferably, the solid carbon source materials will have a particle size of less than about 0.35 mm. This dimension refers to the longest extension of the individual carbon source material particles.

The zinc oxide initially used in the process is a commercially available material and is preferably used in finely divided form, usually as a powder. The particle size distribution of this zinc oxide preferably is such that all the particles are in the range of 0.225 micron in diameter. Smaller particles can also be utilized. Larger particles, where they can be utilized, have a tendency of slowing the reaction down and, therefore, are less desirable.

The carbon source and zinc oxide are utilized in the gasification zone generally in a quantity expressed as the equivalent ratio of zinc oxide to carbon in the range of 0.9 to 1.2. Preferably, about 1.0 gram mol of zinc oxide per gram atom of available carbon in the carbon source is present in the gasification zone. The quantity of available carbon in the carbon source used is generally slightly smaller than the total carbon present in the source if carbonates are present.

The temperature and pressure conditions in the three zones are not critical but preferably are as defined in the following:

| Preferred Operating Conditions | Temperature °C. | Reference Numeral in Drawing |
|---|---|---|
| Preheating zone: | | |
| Feed temperature | Ambient | 1 |
| Zone outlet temperature | 150–970 | 10 |
| Oxidation zone | 500–1200 | 20 |
| Gasification zone | 900–1650 | 30 |
| Zn-combustion zone | 1200–1800 | 40 |
| | Residence Time | |
| Preheating zone | 1–30 min. | 10 |
| Oxidation zone | 2–30 min. | 20 |
| Gasification zone | 10 min.–2 hrs. | 30 |
| Zn-combustion zone | 0.1–10 sec. | 40 |

The pressure conditions in the various reaction sections are not critical. However, to move the materials through the various zones the contacting and reactions are carried out at slightly superatmospheric pressure. If desired, however, the reactions can be carried out at higher pressures, and high pressure carbon monoxide can be produced as the product of the process. The preferred operating pressure range for the process is 1 to 4 atmospheres (101 to 401 kPa).

The beds for preheating, steam oxidation of the zinc, gasification and zinc combustion may be moving beds or agitated beds. The preheating bed is preferably operated as a moving bed in order to achieve a particularly efficient heat and zinc recovery in this bed. If the preheating zone, the zinc oxidation zone and the gasification zone are operated in separate vessels, the gasification zone is preferably operated as a fluidized bed. The zinc oxidation zone, too, is in this case preferably operated as a fluidized bed.

The invention will yet be more fully understood from the following description of the drawing.

FIG. 1 of the drawing schematically shows a flow diagram illustrating the process of this invention. A carbon source such as coal or char is fed via line 1 to a preheater 10. In this preheater 10 the carbon source is countercurrently contacted with a gas stream from line 11. This gas stream is a carbon monoxide and hydrogen-containing gas stream but also contains zinc. Zinc is condensed on the carbon source particles and these particles containing some zinc are removed from the preheater 10 via line 7. Product gas stream that is free of zinc is removed from the preheater 10 via line 4.

The zinc-containing carbon source particles are introduced via line 7 to the zine oxidation zone 20. Into this zinc oxidation zone 20 steam is introduced via line 21. Furthermore, zinc is introduced into this zone via line 22. In this zone 20 the zinc on the carbon source is reacted with steam producing zinc oxide in finely divided form on the carbon source and hydrogen which leaves the zinc oxidation zone via line 11. The carbon source together with zinc oxide is passed from the zinc oxidizing zone 20 vial line 23 to the gasification zone 30. In this gasification zone the carbon source and the zinc oxide are reacted to form the gaseous effluent comprising carbon monoxide and zinc and leaves the gasifier 30 via line 31. The zinc oxide utilized as the oxygen source in this reaction is introduced in part via line 23 from the zinc oxidizer 20 and in part via line 32. Ash is removed from the gasification section 30 via line 33.

The gaseous effluent comprising carbon monoxide and zinc is passed via line 31 to a cooler 51 and a zinc separator 52. Zinc is removed from this zinc separator 52 via line 53. A portion of this zinc removed via line 53 is introduced into the zinc oxidizer via line 22. Another portion of the zinc is passed via line 54 together with air introduced via line 55 into a zinc combustion unit 40. In this zinc combustion unit 40 zinc and air are converted in an exothermic reaction into zinc oxide and a gas consisting essentially of nitrogen. The zinc combustion zone 40 is located in indirect heat exchange relationship inside of the gasification zone. The zinc oxide comprising aerosol is passed via line 41 to a zinc oxide separator such as a cyclone of filter 60. The solid zinc oxide is removed from this separator 60 via line 32 and introduced into the gasifier as explained above. Zinc oxide-free offgas consisting essentially of nitrogen is removed from the separator 60 via line 61. Carbon monoxide-containing gas containing only a small quantity of zinc is removed from the zinc separator 52 via line 57. This gas is introduced into the zinc oxidizer where part of the zinc of this gas is oxidized to zinc oxide. A small portion of zinc remains in the gas stream 11 and is condensed onto the carbon source in the preheater 10. In another variation of this schematic diagram, a portion of the carbon monoxide and zinc-comprising gas in line 31 can be passed directly to the zinc oxidizer. The quantity of this gas is controlled by valve 65.

Figure 2:
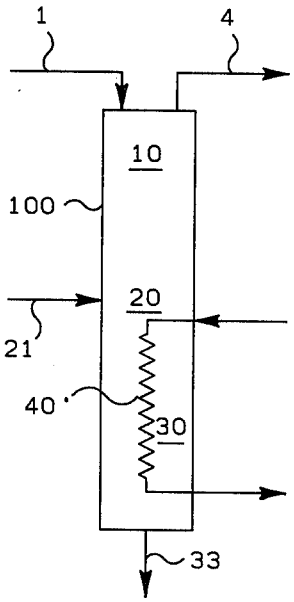
FIG. 2 shows one embodiment of this invention in diagrammatic form.

FIG. 2 shows an embodiment of the present invention in which the preheating zone, the zinc oxidation zone and the gasification zone are all arranged within one long, preferentially vertically arranged housing 100. The feed lines and the product withdrawal lines have been given the same reference numerals as in FIG. 1 so that a detailed explanation of these lines can be avoided. In this embodiment no separation of zinc and no handling of zinc is necessary at all. Rather, the zinc in vapor form is removed from the lower section of the housing 100 as a gas, is partly oxidized in the central portion to form a solid and the remainder is condensed as metal in the upper portion on the carbon source feed and moved back down with this feed where it is finally oxidized with steam. In this embodiment it is necessary to provide an external heating fluid in order to supply the heat necessary for the overall process. In return for this additional heat a higher relative quantity of hydrogen is produced in this embodiment. Any heating fluid can be used for the purposes of supplying the heat necessary for the gasification reaction in the gasification zone 30. The heating coils 40' transmit this heat to the carbon source and the zinc oxide and the cooled heating fluid leaving the coils 40' can be reheated in a, e.g., gas-fired burner (not shown).

Figure 3:
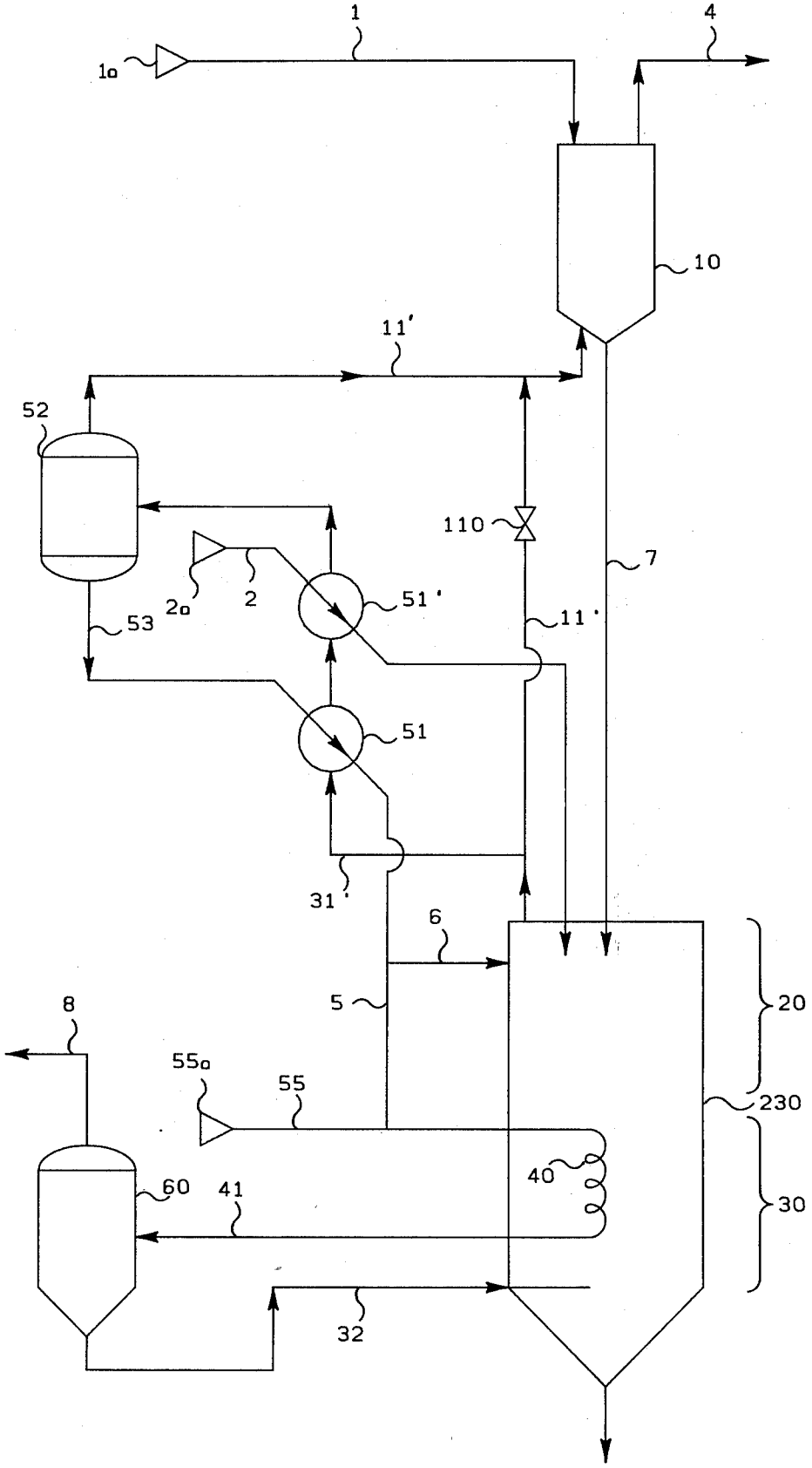
FIG. 3 illustrates a further embodiment of this invention.

A yet further embodiment of this invention is schematically illustrated in the flow diagram of FIG. 3. From a coal reservoir l*a* coal is introduced via line 1 into the preheater 10. Zinc-free carbon monoxide and hydrogen comprising product gas is removed from this preheater 10 via line 4. A product gas stream containing a small quantity of zinc is introduced countercurrently via line 11 into the preheating zone 10. The coal particles remove the zinc from this stream. These coal particles containing condensed thereon some zinc are passed via line 7 to a vessel 230 in which both the zinc oxidation zone 20 and the gasification zone 30 are arranged. From this vessel 230 a zinc, carbon monoxide and hydrogen-containing stream is withdrawn via line 31' and passed through two indirect heat exchangers 51 and 51' to a zinc separator 52. A portion of this stream can be passed directly via line 11 controlled by valve 110 into preheater 10. Generally 0 to about 25 percent of the stream leaving the zinc oxidizer and containing Zn, CO and $H_2$ is passed via line 11 to the preheater. From the zinc separator the carbon monoxide-containing gas stream being lean in zinc is withdrawn via line 11' and introduced into the preheater 10. Zinc is removed from the zinc separator via line 53. The reheated zinc 53 leaving the heat exchanger 51 is in part introduced via line 6 into the zinc oxidation zone 20 where this zinc reacts with steam that is introduced into the vessel 230 from a water or steam source **2*a* via line 2 through the heat exchanger 51', and in part is introduced via line 5 into admixture with air that is supplied from air source 55*a* via line 55 to a zinc combustion zone 40. This zinc combustion zone 40 is in indirect heat exchange relationship with the carbon source and the zinc oxide and supplies the thermal energy consumed during the endothermic gasification reaction. A zinc oxide comprising aerosol is removed from the zinc combustion zone 40 via line 41. Zinc oxide is removed from this aerosol stream in separator 60 and reintroduced via line 32 into the gasification zone as explained in connection with FIG. 1. Gas comprising essentially nitrogen is vented via line 8**.

In the following table a calculated material balance for the various streams shown in FIG. 3 is given. This material balance is based on the assumption of 100 percent efficiency in the heat transfer and reaction steps.

| | Material Balance, kg-mols/hr | | | | | | | |
|---|---|---|---|---|---|---|---|---|
| | Char | Water | Air | Product Gas | Zinc Reacted With Air | Zinc Injected Into Steam Oxidizer | Char to Steam Oxidizer | Nitrogen |
| Reference Numerals (FIG. 3 of drawing) | 1 | 2 | 3 | 4 | 5 | 6 | 7 | 8 |
| Carbon (C) | 6.36 | | | | | | 6.36 | |
| Hydrogen (H) | 0.80 | | | | | | 0.80 | |
| Nitrogen (N) | 0.04 | | | | | | 0.04 | |
| Sulfur (S) | 0.11 | | | | | | 0.11 | |
| Oxygen ($O_2$) | | | 1.91 | | | | | |
| Nitrogen ($N_2$) | | | 7.22 | | | | | 7.22 |
| CO | | | | 6.12 | | | | |
| $CO_2$ | | | | 0.24 | | | | |
| NO | | | | 0.04 | | | | |
| $SO_2$ | | | | 0.11 | | | | |
| Zn | | | | | 3.82 | 2.59 | 0.86 | |
| Hydrogen ($H_2$) | | | | 3.45 | | | | |
| $H_2O$ | | 3.45 | | 0.40 | | | | |
| Ash | 0.18 | | | | | | 0.18 | |
| Totals | 7.49 | 3.45 | 9.13 | 10.36 | 3.82 | 2.59 | 8.35 | 7.22 |

The invention will be yet more fully understood from the following calculated example.

EXAMPLE

In a system similar to the system shown in FIG. 3, coal char is countercurrently contacted with gases. These gases are the gases lean in zinc content leaving the zinc separator together with about 11 percent of gases coming direct from the steam oxidation zone 20 and having not passed through the heat exchangers 51, 51' and the zinc separator 52. The char preheater is operated as a moving bed. By the contact with these gases the char is preheated to about 900° C. The hot char with the zinc both from the lean gases from the separator and the 11 percent of the zinc-rich gases from the oxidizer 20 is contacted together with additional injected zinc in the zinc oxidation zone with steam. In this zone that is operated at a temperature of 900° to 1050° C., the zinc is converted to zinc oxide generating a corresponding quantity of hydrogen. Char with zinc oxide deposited thereon is then passed to the gasification zone 30 where additional heat is supplied indirectly by combusting zinc with air. The zinc oxide formed in this combustion is separated from the nitrogen and the residual air and injected into the gasification zone 30 to supply additional oxygen. The gasification zone 30 is operated at 1000° to 1100° C.

Reasonable variations and modifications which will become apparent to those skilled in the art can be made in this invention without departing from the spirit and scope thereof.

I claim:

1. In a process for gasifying a solid carbon source wherein said solid carbon source is contacted wit zinc oxide at a temperature of 900° C to 1650° C to form a carbon monoxide and zinc-comprising gas and wherein said zinc is separated from said gas, oxidized and recycled into contact with the carbon source and wherein a carbon monoxide-comprising gas is recovered as a product of the process, the improvement comprising a. passing said carbon source sequentially through a preheater zone, a zinc oxidizing zone and a gasification zone, b. contacting said solid carbon source in said preheating zone with at least a portion of the gas produced in the gasification zone and condensing zinc on said solid carbon source, c. introducing the preheated solid carbon source, and zinc and steam into said zinc oxidation zone such as to form a mixture comprising said carbon source, zinc and steam, d. reacting said mixture such as to form solids comprising said solid carbon source and zinc oxide, and hydrogen, and e. passing said solids into said gasification zone and reacting said solids to form said carbon monoxide and zinc-comprising gas.

2. A process in accordance with claim 1 comprising a. dividing said carbon monoxide and zinc-containing gas into a first and a second part, b. contacting said carbon source with said first part of said carbon monoxide and zinc-comprising gas.

3. A process in accordance with claim 1 comprising a. separating a major portion of the zinc from the carbon monoxide and zinc-comprising gas in a zinc separation zone leaving a lean carbon monoxide comprising-gas stream containing a minor portion of zinc, b. contacting said carbon source with at least a portion of said lean carbon monoxide-comprising gas stream.

4. A process in accordance with claim 1 comprising passing at least a portion of said zinc and carbon monoxide-comprising gas from said gasification zone into said zinc oxidation zone and withdrawing an oxidation zone offgas from said oxidation zone and passing said oxidation zone offgas from said oxidation zone to said preheating zone into contact with said carbon source.

5. A process in accordance with claim 3 comprising a. introducing a first portion of the separated zinc into said zinc oxidation zone, b. oxidizing a second portion of said separated zinc with a free oxygen-containing gas in a zinc combustion zone to form zinc oxide, c. separating the zinc oxide from the offgas formed in this oxide combustion zone, d. reintroducing the zinc oxide so separated into the gasification zone.

6. A process in accordance with claim 5 comprising transferring at least a portion of the heat generated in said zinc combustion zone by indirect heat exchange to the gasification zone.

7. A process in accordance with claim 5 wherein said free oxygen-containing gas is air.

8. A process in accordance with claim 5 wherein said second portion of zinc is large enough to supply the heat consumed in the gasification reaction.

9. A process in accordance with claim 1 wherein said carbon source is passed as a moving bed through said preheating zone and wherein said portion of said gas produced from said gasification zone is passed countercurrently through said moving bed of said carbon source.

10. A process in accordance with claim 1 wherein said carbon monoxide and zinc-containing gas is cooled to a temperature below the boiling point of zinc, wherein liquid zinc is separated from said cooled gas leaving a carbon monoxide-containing gas with only a small concentration of zinc and wherein this carbon monoxide-containing gas with only a small quantity of zinc is passed countercurrently into contact with the carbon source in said preheating zone such as to produce a carbon monoxide-containing gas being free of zinc and a stream of said carbon source containing a small amount of zinc.

11. A process in accordance with claim 1 wherein said carbon monoxide and zinc-containing gas is cooled to a temperature below the boiling point of zinc, wherein liquid zinc is separated from said cooled gas leaving a carbon monoxide-comprising gas with only a small concentration of zinc and wherein at least a portion of this carbon monoxide-containing gas with only a small quantity of zinc is passed into said oxidation zone and wherein an oxidation zone offgas is passed from the oxidation zone to the preheating zone.

* * * * *

UNITED STATES PATENT AND TRADEMARK OFFICE

CERTIFICATE OF CORRECTION

PATENT NO. : 4,070,160

DATED : January 24, 1978

INVENTOR(S) : John E. Cottle

It is certified that error appears in the above-identified patent and that said Letters Patent are hereby corrected as shown below:

Column 7, line 32 (claim 1), "wit" should read --- with ---; line 48 (claim 1), "and" should be deleted.
Column 8, line 23 (claim 5) "oxide" should read --- zinc ---.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*